US006848435B2

(12) United States Patent
Kitamura et al.

(10) Patent No.: US 6,848,435 B2
(45) Date of Patent: Feb. 1, 2005

(54) CONTROL SYSTEM FOR COMPRESSION IGNITION INTERNAL COMBUSTION ENGINE

(75) Inventors: Toru Kitamura, Saitama-ken (JP); Yoshimasa Kaneko, Saitama-ken (JP); Toshihiro Yamaki, Saitama-ken (JP)

(73) Assignee: Honda Motor Co., Ltd., Tokyo (JP)

( * ) Notice: Subject to any disclaimer, the term of this patent is extended or adjusted under 35 U.S.C. 154(b) by 0 days.

(21) Appl. No.: 10/868,033

(22) Filed: Jun. 16, 2004

(65) Prior Publication Data

US 2004/0250803 A1 Dec. 16, 2004

(30) Foreign Application Priority Data

Jun. 16, 2003 (JP) ..... 2003/171346

(51) Int. Cl.[7] ..... F02B 47/08

(52) U.S. Cl. ..... 123/568.31; 123/568.11

(58) Field of Search ..... 123/568.11, 568.12, 123/568.14, 568.21, 568.31

(56) References Cited

U.S. PATENT DOCUMENTS 5,732,688 A * 3/1998 Charlton et al. ..... 123/568.12

* cited by examiner

*Primary Examiner*—Bibhu Mohanty
(74) *Attorney, Agent, or Firm*—Arent Fox PLLC

(57) ABSTRACT

A control system for a compression ignition internal combustion engine, which is capable of properly estimating the temperature of combustion gases, and thereby accurately controlling the temperature of working medium according to the estimated temperature of the combustion gases, to thereby prevent knocking and misfire from occurring. A compression ignition internal combustion engine causes combustion of an air-fuel mixture by self-ignition in a combustion chamber, and includes an EGR device that causes part of combustion gases generated by the combustion to exist as EGR gases in the combustion chamber. The control system estimates the amount of EGR gases existing in the combustion chamber, estimates the temperature of combustion gases generated by combustion of working medium including the air-fuel mixture and the EGR gases, according to the estimated amount of the EGR gases, and determines the amount of the EGR gases which should be caused to exist in the combustion chamber, according to the estimated temperature of the combustion gases.

5 Claims, 7 Drawing Sheets

CONTROL SYSTEM FOR COMPRESSION IGNITION INTERNAL COMBUSTION ENGINE

BACKGROUND OF THE INVENTION

1. Field of the Invention

This invention relates to a control system for a compression ignition internal combustion engine that causes combustion of an air-fuel mixture by self-ignition.

2. Description of the Related Art

Conventionally, a control system of the above-mentioned kind has been proposed e.g. in Japanese Laid-Open Patent Publication (Kokai) No. 2001-289092. In the engine, the timing for opening and closing an intake valve and an exhaust valve of each cylinder is configured to be variable. Further, in the control system, paying attention to the relationship between the timing of occurrence of self-ignition and the temperature of working medium (working gases) at the start of a compression stroke that the self-ignition timing is advanced as the temperature of working medium at the start of the compression stroke is higher, the temperature of working medium is controlled for control of the timing of occurrence of self-ignition. More specifically, by setting the valve-closing timing of the exhaust valves to be advanced, and the valve-opening timing of the intake valves to be delayed, part of combustion gases is caused to remain in a combustion chamber (internal EGR). Further, the amount of the combustion gases remaining in the combustion chamber (hereinafter referred to as "the internal EGR amount") is controlled according to the temperature of the exhaust gases, which is detected by a sensor provided in an exhaust pipe, whereby the temperature of the working medium is controlled. This causes self-ignition to take place in suitable timing, whereby knocking and misfire are prevented from occurring.

As described above, the conventional control system is configured such that the heat of the combustion gases is utilized to cause self-ignition in suitable timing, and the temperature of working medium is controlled by controlling the internal EGR amount. The temperature of the exhaust gases is used as a parameter indicative of the temperature of the combustion gases. In the control system, however, the sensor for detecting the temperature of exhaust gases is provided in the exhaust pipe, which means that the temperature of exhaust gases already discharged from the combustion chamber is detected by the sensor. Therefore, the temperature of exhaust gases detected by the sensor does not appropriately reflect the temperature of the combustion gases which are to be generated by the following combustion and remain in the combustion chamber. The above difference between the detected temperature of the exhaust gases and the temperature of the residual combustion gases tends to be larger particularly during a transient operation of the engine, since the degree of change in the temperature of combustion gases increases due to changes in operating conditions of the engine.

As described above, when the detected temperature of the exhaust gases is different from the temperature of the residual combustion gases, it is impossible to accurately control the temperature of working medium at the start of the compression stroke even if the internal EGR is controlled according to the detected temperature of the exhaust gases. As a result, self-ignition cannot be caused in suitable timing, which makes it impossible to prevent knocking and misfire from occurring.

SUMMARY OF THE INVENTION

It is an object of the invention to provide a control system for a compression ignition internal combustion engine, which is capable of properly estimating the temperature of combustion gases, and thereby accurately controlling the temperature of working medium according to the estimated temperature of the combustion gases, to thereby prevent knocking and misfire from occurring.

To attain the above object, the present invention provides a control system for a compression ignition internal combustion engine that causes combustion of an air-fuel mixture by self-ignition in a combustion chamber, and includes an EGR device that causes part of combustion gases generated by the combustion to exist as EGR gases in the combustion chamber, the control system comprising:

EGR gas amount-estimating means for estimating an amount of EGR gases existing in the combustion chamber;

combustion gas temperature-estimating means for estimating temperature of combustion gases to be generated by combustion of working medium including the air-fuel mixture and the EGR gases, according to the estimated amount of the EGR gases; and target EGR gas amount-determining means for determining a target amount of EGR gases which should be caused to exist in the combustion chamber, according to the estimated temperature of the combustion gases.

With the arrangement of this control system, the amount of the EGR gases, which are combustion gases caused to exist in the combustion chamber after combustion, is estimated, and the temperature of combustion gases to be generated by combustion of working medium including the air-fuel mixture and the EGR gases is estimated according to the estimated amount of the EGR gases. Then, the amount of EGR gases which should be caused to exist in the combustion chamber, is determined according to the estimated temperature of the combustion gases. In this case, the term "EGR gases" is intended to include combustion gases caused to remain by internal EGR, and combustion gases recirculated by exhaust gas recirculation. As described above, since the temperature of combustion gases to be generated by the combustion of working medium including the EGR gases is estimated according to the amount of EGR gases existing (remaining or recirculated) in the combustion chamber, it is possible to properly predict the temperature of combustion gases, while causing the amount of heat of the EGR gases to be properly reflected therein.

Further, since the amount of EGR gases which should be caused to exist in the combustion chamber, is determined according to the temperature of combustion gases estimated as above, the amount of EGR gases can be properly set according to the temperature of combustion gases which are to be caused to actually exist in the combustion chamber, in a manner suited to the varying temperature. Therefore, differently from the conventional control system, the temperature of working medium at the start of the next compression stroke can be accurately controlled without being adversely affected by a sharp change in the temperature of the combustion gases even during a transient operation of the engine. This makes it possible to accurately control the temperature of working medium at the start of the compression stroke to a suitable temperature for self-ignition, thereby making it possible to prevent knocking and misfire from occurring.

Further, since the temperature of combustion gases is determined by estimation thereof, it is possible to dispense with a sensor for detecting the temperature of combustion gases, thereby making it possible to construct the control system at reduced costs.

Preferably, the control system further comprises charged gas amount-estimating means for estimating an amount of working medium charged in the combustion chamber, and the combustion gas temperature-estimating means estimates the temperature of the combustion gases further according to the estimated amount of the charged working medium.

With the arrangement of this preferred embodiment, the temperature of combustion gases is estimated according to the estimated amount of the charged working medium in addition to the estimated amount of the EGR gases. This makes it possible to more properly predict the temperature of combustion gases, while causing a ratio of the amount of the EGR gases to the amount of the working medium, i.e. a rise in the temperature of the working medium, caused by the EGR gases, to be reflected therein.

Preferably, the engine is configured to be capable of switching a combustion mode thereof between a compression ignition combustion mode in which combustion of the air-fuel mixture is caused by self-ignition, and a spark ignition combustion mode in which combustion of the air-fuel mixture is caused by spark ignition, the control system further comprising combustion mode-determining means for determining which of the compression ignition combustion mode and the spark ignition combustion mode should be selected as the combustion mode, and intake air temperature-detecting means for detecting temperature of intake air drawn into the combustion chamber, and the combustion gas temperature-estimating means estimates the temperature of the combustion gases according to the estimated amount of the EGR gases when the determined combustion mode is the compression ignition combustion mode, and estimates the temperature of the combustion gases according to the detected temperature of the intake air when the determined combustion mode is the spark ignition combustion mode.

With the arrangement of this preferred embodiment, when the determined combustion mode is the compression ignition combustion mode, the temperature of the combustion gases is estimated according to the estimated amount of EGR gases, whereas when the determined combustion mode is the spark ignition combustion mode, the temperature of the combustion gases is estimated according to the detected temperature of intake air. In general, in the spark ignition combustion mode, the air-fuel mixture is ignited using a spark plug, and hence differently from the case where the compression ignition combustion mode is employed, there is no need to maintain the temperature of working medium at a temperature suitable for making self-ignition easy to occur, so that the ratio of the amount of EGR gases to the amount of intake air is very small. Therefore, in the spark ignition combustion mode, the temperature of the combustion gases can be properly estimated by estimating the temperature according to the temperature of intake air.

Further, it is known that in general, when the temperature of exhaust gases is very high due to very high output of the engine, a larger amount of fuel than usual is injected (rich fuel control) with a view to lowering combustion temperature by fuel left unburned so as to lower the temperature of exhaust gases to thereby suppress a rise in the temperature of a catalytic device that reduces exhaust emissions, for protection of the catalytic device. In contrast, according to the present invention, the temperature of combustion gases can be properly estimated, as described above, so that the aforementioned rich fuel control for lowering the temperature of exhaust gases can be carried out only when the temperature of exhaust gases becomes actually very high, which makes it possible to improve the fuel economy.

More preferably, the combustion gas temperature-estimating means estimates the temperature of the working medium at the start of a compression stroke according to the estimated amount of the EGR gases and the detected temperature of the intake air when the determined combustion mode is the compression ignition combustion mode, and estimates the temperature of the combustion gases according to the estimated temperature of the working medium and a torque demanded of the engine.

Preferably, the EGR device is an internal EGR device that causes the part of combustion gases generated by the combustion to exist as the EGR gases in the combustion chamber.

With this arrangement of the preferred embodiment, the EGR gases are caused to remain in the combustion chamber by internal EGR, which enables the temperature of combustion gases used as EGR gases to be directly estimated, so that the aforementioned advantageous effects provided by the present invention can be obtained more effectively.

The above and other objects, features, and advantages of the present invention will become more apparent from the following detailed description taken in conjunction with the accompanying drawings.

DETAILED DESCRIPTION OF THE PREFERRED EMBODIMENTS

Figure 1:
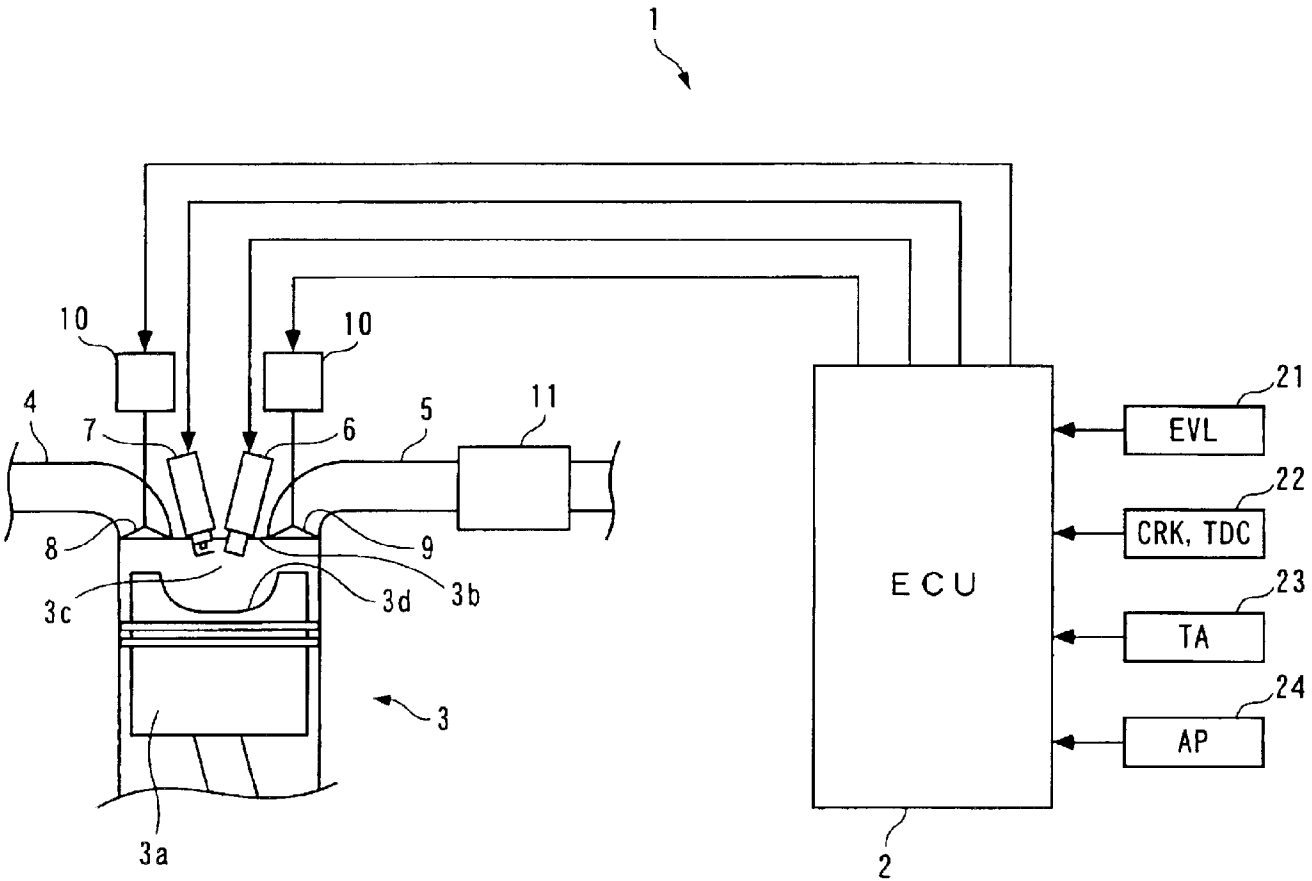
FIG. 1 is a block diagram schematically showing the arrangement of a control system according to the present invention and an internal combustion engine to which the control system is applied.

The invention will now be described in detail with reference to the drawings showing a preferred embodiment thereof. Referring first to FIG. 1, there is schematically shown the arrangement of a control system 1 according to the present invention and a compression ignition internal combustion engine (hereinafter simply referred to as "the engine") 3 to which the control system is applied.

The engine 3 is a straight type four-cylinder gasoline engine installed on a vehicle, not shown. The engine 3 has four cylinders (only one of which is shown) in each of which a combustion chamber 3*c* is defined between a piston 3*a* and a cylinder head 3*b*. The piston 3*a* has a central portion of a top surface thereof formed with a recess 3*d*. The cylinder head 3*b* has an intake pipe 4 and an exhaust pipe 5 extending therefrom. In the exhaust pipe 5, there is provided a three-way catalyst 11 for reducing exhaust emissions.

The cylinder head 3*b* has an injector 6 and a spark plug 7 inserted therein in a manner facing a combustion chamber 3*c*. The injector 6 is connected to a fuel pump, not shown, and a fuel injection time period (time period over which the injector 6 is open) thereof is controlled by an ECU 2, referred to hereinafter. Further, the spark plug 7 has a high voltage applied thereto in timing corresponding to ignition timing by a drive signal from the ECU 2, and subsequent interruption of the application of the high voltage causes a spark discharge to ignite the air-fuel mixture within the cylinder. The engine 3 is configured to be capable of switching the combustion mode thereof between a spark ignition combustion mode (hereinafter referred to as "the SI combustion mode") in which the mixture within the combustion chamber 3*c* is ignited by the spark of the spark plug 7, and a compression ignition combustion mode (hereinafter referred to as "the CI combustion mode") in which the mixture within the combustion chamber 3*c* is ignited by self-ignition.

An intake valve 8 and an exhaust valve 9 for each cylinder are actuated by electromagnetic valve mechanisms 10 (EGR device), respectively. Each of the electromagnetic valve mechanisms 10 includes two electromagnets, not shown. Timing of energization and deenergization of the electromagnets is controlled by drive signals from the ECU 2, whereby the intake valve 8 and the exhaust valve 9 are actuated such that they are opened and closed in timing (hereinafter referred to as "the valve timing") controlled as desired.

Further, by providing control such that the valve-closing timing of the exhaust valve 9 is advanced than usual, and the valve-opening timing of the intake valve 8 is delayed than usual, it is possible to cause part of combustion gases to remain as EGR gases in the combustion chamber 3*c* (hereinafter, this operation is referred to as "internal EGR") and further control the EGR gas amount, which is the amount of the remaining combustion gases.

The electromagnetic valve mechanism 10 for actuating the exhaust valve 9 has a valve lift sensor 21 mounted therein. The valve lift sensor 21 detects an actual valve lift amount EVL of the exhaust valve 9, and delivers a signal indicative of the sensed valve lift amount to the ECU 2.

The ECU 2 receives pulses of a CRK signal and a TDC signal as pulse signals delivered from a crank angle sensor 22., Each pulse of the CRK signal is delivered in accordance with rotation of a crankshaft, not shown, of the engine 3, whenever the crankshaft rotates through a predetermined angle. The ECU 2 determines an engine speed NE based on the CRK signal. Further, the ECU 2 determines actual valve-closing timing CAEVC of the exhaust valve 9 based on the valve lift amount EVL and the CRK signal. The TDC signal indicates that each piston 3*a* in the associated cylinder is in a predetermined crank angle position in the vicinity of the TDC (top dead center) position at the start of an intake stroke, and each pulse of the TDC signal is delivered whenever the crankshaft rotates through 180 degrees in the case of the illustrated four-cylinder engine 3.

Further, the ECU 2 receives an electric signal indicative of the temperature TA (hereinafter referred to as "the intake air temperature TA") of intake air drawn into the combustion chamber 3*c*, from an intake air temperature sensor 23 (intake air temperature-detecting means), and an electric signal indicative of the degree of opening or stepped-on amount AP (hereinafter referred to as "the accelerator opening AP") of an accelerator pedal, not shown, from an accelerator opening sensor 24.

In the present embodiment, the ECU 2 forms EGR gas amount-estimating means, combustion gas temperature-estimating means, target EGR gas amount-determining means, charged gas amount-estimating means, and combustion mode-determining means. The ECU 2 is implemented by a microcomputer including an I/O interface, a CPU, a RAM, and a ROM, none of which are specifically shown. The signals delivered from the sensors 21 to 24 described above to the ECU 25 are each input to the I/O interface after A/D conversion and waveform shaping, and then input to the CPU.

In response to these input signals, the CPU determines the operating conditions of the engine 3, to determine which of the SI combustion mode and the CI combustion mode should be selected as the combustion mode of the engine 3, based on the determined operating conditions in accordance with control programs read from the ROM, and controls e.g. the amount of the EGR gases in the CI combustion mode depending on the result of the determination.

Figure 5:
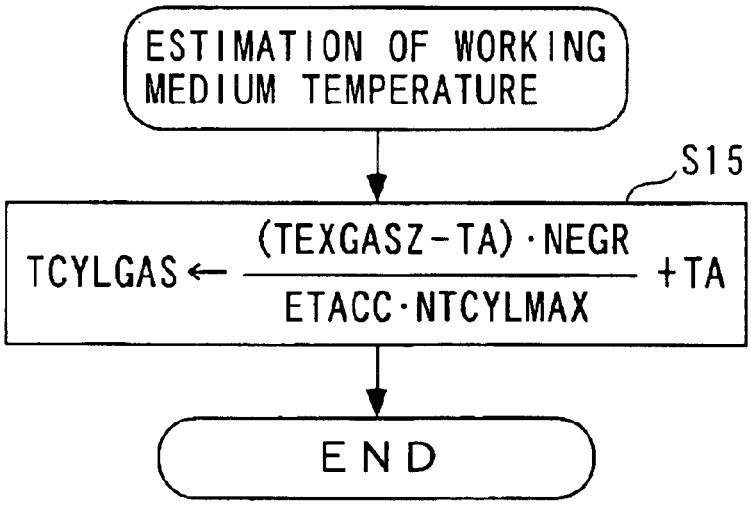
FIG. 5 is a flowchart showing a working medium temperature-estimating process.
Figure 6:
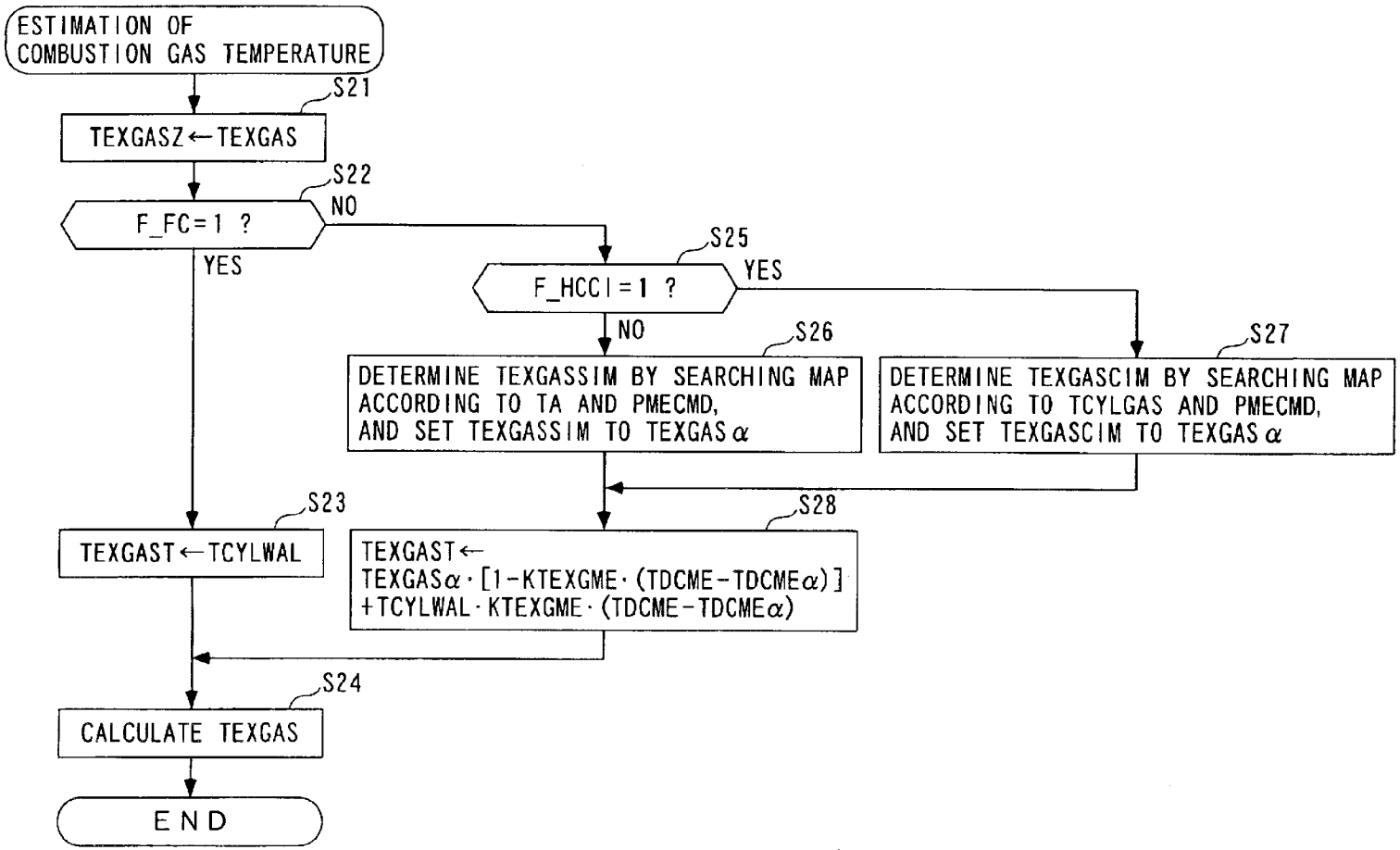
FIG. 6 is a flowchart showing a combustion gas temperature-estimating process.
Figure 9:
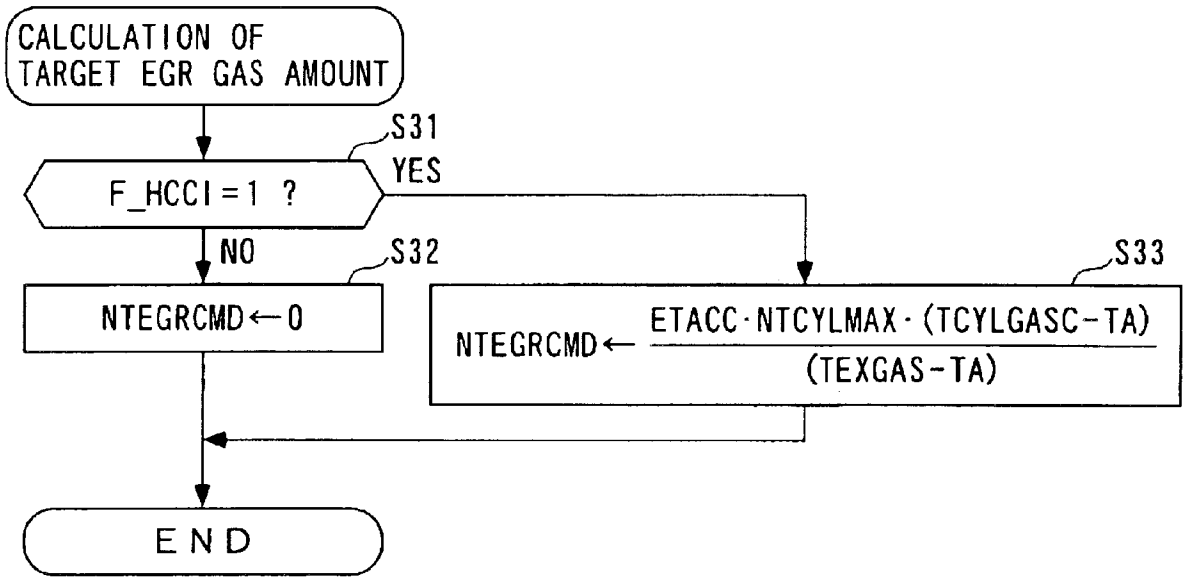
FIG. 9 is a flowchart showing a target EGR gas amount-calculating process.

Now, a description will be given of the outline of the control processes executed by the ECU 2. First, the ECU 2 determines the combustion mode of the engine 3 (FIG. 2), and calculates a target working medium temperature TCYLGASC, which is a target value of the temperature of working medium (working gases) including the air-fuel mixture and the EGR gases at the start of a compression stroke (FIG. 3). Further, the ECU 2 estimates an actual amount of the EGR gases remaining in the combustion chamber 3*c*, as an estimated EGR gas amount NEGR (FIG. 4), and an actual temperature of working medium at the start of the compression stroke as an estimated working medium temperature TCYLGAS (FIG. 5). Furthermore, the ECU 2 estimates (predicts) the temperature of combustion gases generated by combustion of the working medium, as an estimated combustion gas temperature TEXGAS (estimated temperature of the combustion gases) (FIG. 6). Finally, the ECU 2 calculates a target EGR gas amount NTEGRCMD (the amount of EGR gases which should be caused to exist in the combustion chamber) using the calculated target working medium temperature TCYLGASC and the estimated combustion gas temperature TEXGAS (FIG. 9). Details of each of the above processes will be described hereinafter.

Figure 2:
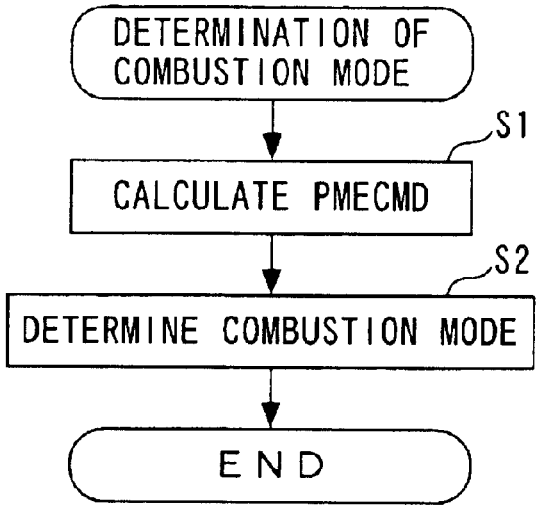
FIG. 2 is a flowchart showing a combustion mode-determining process.
Figure 3:
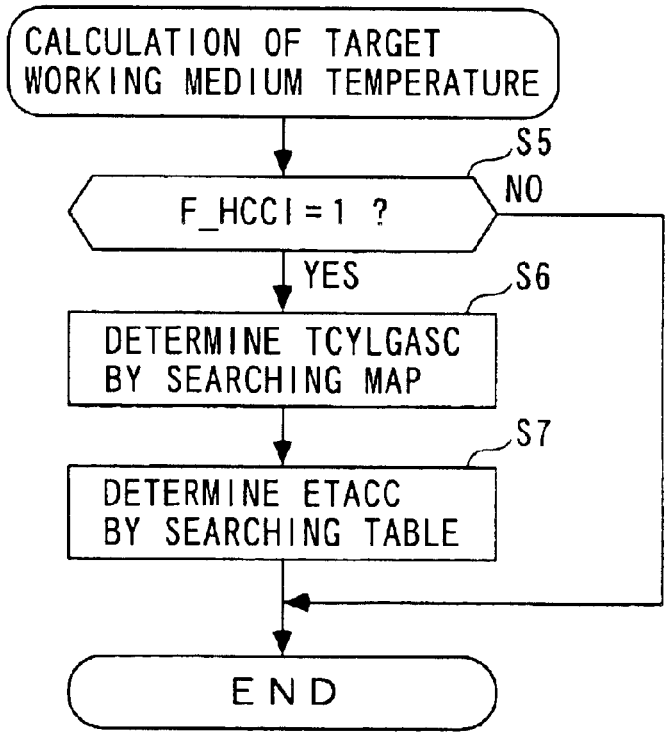
FIG. 3 is a flowchart showing a target working medium temperature-calculating process.

A combustion mode-determining process shown in FIG. 2 is carried out at predetermined time intervals (e.g. of 20 msec.). First, in a step 1, a demanded torque PMECMD of the engine 3 is calculated using the engine speed NE by the following equation (1):

$$PMECMD=CONST\cdot PSE/NE \quad (1)$$

wherein, CONST represents a constant, and PSE represents an output demanded of the engine 3. The demanded output PSE is set by looking up a PSE table, not shown, according to the accelerator opening AP and the engine speed NE. The PSE table is comprised of a plurality of tables configured respectively for predetermined values of the accelerator opening AP within a range between 0 to 100%. When the accelerator opening AP indicates an intermediate value between two of the predetermined values of the PSE table, the demanded output PSE is calculated by interpolation.

Further, in the above tables, the demanded output PSE is set to a larger value, as the engine speed NE is larger and the accelerator opening AP is larger.

Then, the combustion mode is determined (step 2), followed by terminating the present process. The determination of the combustion mode is carried out based on a combustion mode-setting map, not shown, according to the calculated demanded torque PMECMD and the engine speed NE. In the combustion mode-setting map, the combustion mode is set to the CI combustion mode when the demanded torque PMECMD is in a low-load to intermediate-load region and at the same time the engine speed NE is in a low-to-medium rotational speed region, and otherwise set to the SI combustion mode. Further, when the combustion mode is set to the CI combustion mode, a CI combustion mode flag F_HCCI is set to 1, and otherwise set to 0.

It should be noted that in the case of the combustion mode being the SI combustion mode, if the estimated combustion gas temperature TEXGAS has exceeded a predetermined temperature (e.g. 800° C.), the aforementioned fuel injection time period is controlled such that a larger amount of fuel than usual is injected (rich fuel control), whereby the temperature of exhaust gases is lowered to prevent the temperature of the three-way catalyst 11 from becoming too high, for protection thereof.

A target working medium temperature-calculating process shown in FIG. 3 is performed at predetermined time intervals (e.g. of 10 msec.). First, in a step 5, it is determined whether or not the above CI combustion mode flag F_HCCI is equal to 1. If the answer to this question is negative (NO), i.e. if the engine 3 is in the SI combustion mode, the present process is immediately terminated.

On the other hand, if the answer to the question of the step 5 is affirmative (YES), i.e. if the engine 3 is in the CI combustion mode, in a step 6, the target working medium temperature TCYLGASC is calculated according to the engine speed NE and the demanded torque PMECMD, by searching a map, not shown. The target working medium temperature TCYLGASC is set so as to control the temperature of working medium at the start of the compression stroke to a suitable temperature for making self-ignition easy to occur. In this map, the target working medium temperature TCYLGASC is set to a larger value, as the engine speed NE is lower and the demanded torque PMECMD is smaller. This is because as the engine speed NE is lower, the repetition period of the combustion cycle of each cylinder is longer, whereby self-ignition becomes more difficult to occur, and further as the demanded torque PMECMD is smaller, the amount of injected fuel becomes smaller, whereby self-ignition becomes more difficult to occur, so that to make self-ignition easy to occur, it is required to raise the temperature of working medium.

Then, target charging efficiency ETACC (estimated charged-gas amount) is determined based on the calculated target working medium temperature TCYLGASC, by searching a table, not shown, in a step 7, followed by terminating the present process. The target charging efficiency ETACC represents a target value of the charging efficiency of working medium (ratio of the amount of working medium to be charged in the combustion chamber 3*c*, with respect to the sum of the capacity of the combustion chamber 3*c* and piston displacement). In the above table, the target charging efficiency ETACC is set to a larger value, as the target working medium temperature TCYLGASC is higher. This is because as the target working medium temperature TCYLGASC is higher, it is necessary to cause a larger amount of the EGR gases to remain in the combustion chamber 3*c* so as to raise the temperature of the working medium.

Figure 4:
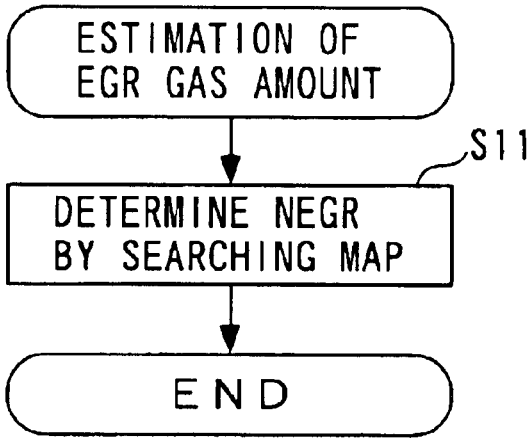
FIG. 4 is a flowchart showing an EGR gas amount-estimating process.

An EGR gas amount-estimating process shown in FIG. 4 is executed only in the CI combustion mode, by an interrupt handling routine in synchronism with inputting of each pulse of the TDC signal. In this process, in a step 11, the estimated EGR gas amount NEGR is determined according to actual valve-closing timing CAEVCACT of the exhaust valve 9 and the demanded torque PMECMD, by searching a map, not shown. In the map, the estimated EGR gas amount NEGR is set to a larger value, as the valve-closing timing CAEVCACT of the exhaust valve 9 is advanced, and the demanded torque PMECMD is larger. This is because as the valve-closing timing of the exhaust valve 9 is advanced, the combustion gases are difficult to be emitted into the exhaust pipe 5, which increases the amount of the EGR gases, and further as the demanded torque PMECMD is larger, a larger amount of combustion gases are generated, which increases the amount of remaining EGR gases.

Similarly to the EGR gas amount-estimating process described above, a working medium temperature-estimating process shown in FIG. 5 is executed only in the CI combustion mode, by an interrupt handling routine in synchronism with inputting of each pulse of the TDC signal. In this process, in a step 15, the estimated working medium temperature TCYLGAS is calculated using an intake air temperature TA, the estimated EGR gas amount NEGR determined in the step 11 in FIG. 4, and the target charging efficiency ETACC determined in the step 7 in FIG. 3, by the following equation (2):

$$TCYLGAS=(TEXGASZ-TA)\cdot NEGR/ETACC\cdot NTCYLMAX+TA \quad (2)$$

wherein TEXGASZ represents the immediately preceding value of the estimated combustion gas temperature TEXGAS calculated by the FIG. 6 process, and NTCYLMAX represents the sum of the capacity of the combustion chamber 3*c* and piston displacement (hereinafter referred to as "the maximum charged-gas amount").

(TEXGASZ−TA) on the right side of the equation (2) represents the temperature difference between the temperature of the combustion gases and that of fresh air, and NEGR/ETACC·NTCYLMAX represents a ratio of the amount of EGR gases to the amount of working medium including the EGR gases. Therefore, the product of these, i.e. the first term on the right side of the equation (2) represents a rise in the temperature of working medium, caused by the EGR gases. By adding the intake air temperature TA to the first term, it is possible to properly calculate the estimated working medium temperature TCYLGAS, which is the actual temperature of working medium at the start of the compression stroke.

A combustion gas temperature-estimating process shown in FIG. 6 is executed by an interrupt handling routine in synchronism with inputting of each pulse of the TDC signal. First, in a step 21, the present estimated combustion gas temperature TEXGAS is set to the immediately preceding value TEXGASZ thereof. It should be noted that the above immediately preceding value TEXGASZ is set to a predetermined temperature (e.g. 150° C. at the start of the engine 3. Then, it is determined in a step 22 whether or not a fuel-cut flag F_FC is equal to 1. If the answer to this question is affirmative (YES), i.e. if fuel cut-off (hereinafter referred to as "F/C") operation of the engine 3 is being executed, a provisional combustion gas temperature value TEXGAST is set to a predetermined value TCYLWAL (step 23). It should be noted that when combustion is not executed due to F/C operation, the predetermined value TCYLWAL corresponds to the temperature of the cylinder block of the engine 3, heated by combustion carried out so far, and is 80° C., for example.

Then, the present estimated combustion gas temperature TEXGAS is calculated using the immediately preceding value TEXGASZ, and the provisional combustion gas temperature value TEXGAST set as above, by the following equation (3) (step 23), followed by terminating the present process.

$$TEXGAS=TEXGAST\cdot(1-TDTGAS)+TEXGASZ\cdot TDTGAS \quad (3)$$

wherein TDTGAS represents a predetermined averaging coefficient (e.g. 0.9) smaller than a value of 1.0.

On the other hand, if the answer to the question of the step 22 is negative (NO), i.e. if F_FC=0 holds, which means that the F/C operation is not being executed, it is determined in a step 25 whether or not a CI combustion mode flag F_HCCI is equal to 1. If the answer to this question is negative (NO), i.e. if the engine 3 is in the SI combustion mode, the process proceeds to a step 26, wherein a map value TEXGASSIM is determined by searching a TEXGASSIM map for the SI combustion mode according to the intake air temperature TA and the demanded torque PMECMD, and set to an intermediate combustion gas temperature value TEXGASα. The intermediate combustion gas temperature value TEXGAS α corresponds to the temperature of the combustion gases directly obtained from combustion of the working medium (assuming that the temperature of the combustion gases is not externally influenced).

Figure 7:
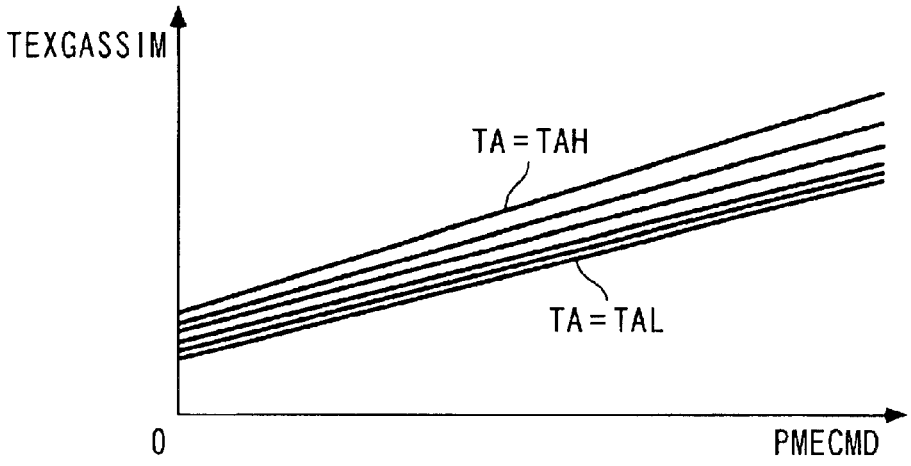
FIG. 7 is a diagram showing a TEXGASSIM map used in the FIG. 6 process.

FIG. 7 shows the TEXGASSIM map for the SI combustion mode. In this map, as the intake air temperature TA is higher and as the demanded torque PMECMD is larger, the map value TEXGASSIM is set to a larger value. This is because as the intake air temperature TA is higher, the temperature of the mixture filled in the combustion chamber 3*c* is higher, whereby the temperature of the combustion gases becomes higher, and further as the demanded torque PMECMD is larger, the output of the engine 3 is larger, whereby the amount of heat generated by combustion, i.e. the temperature of combustion gases becomes higher. It should be noted that the map value TEXGASSIM is set with respect to a total of six predetermined values of the intake temperature TA between a predetermined lower limit value TAL (e.g. −10° C.) and a predetermined upper limit value TAH (e.g. 100° C.), and if the detected intake air temperature TA is not equal to any of the predetermined values, the map value TEXGASSIM is calculated by interpolation.

On the other hand, if the answer to the question of the step 25 is affirmative (YES), i.e. if F_HCCL=1 holds, which means that the engine 3 is in the CI combustion mode, the process proceeds to a step 27, wherein a map value TEXGASCIM is determined by searching a TEXGASCIM map for the CI combustion mode according to the estimated working medium temperature TCYLGAS calculated in the step 15 and the demanded torque PMECMD, and set to the intermediate combustion gas temperature value TEXGASα.

Figure 8:
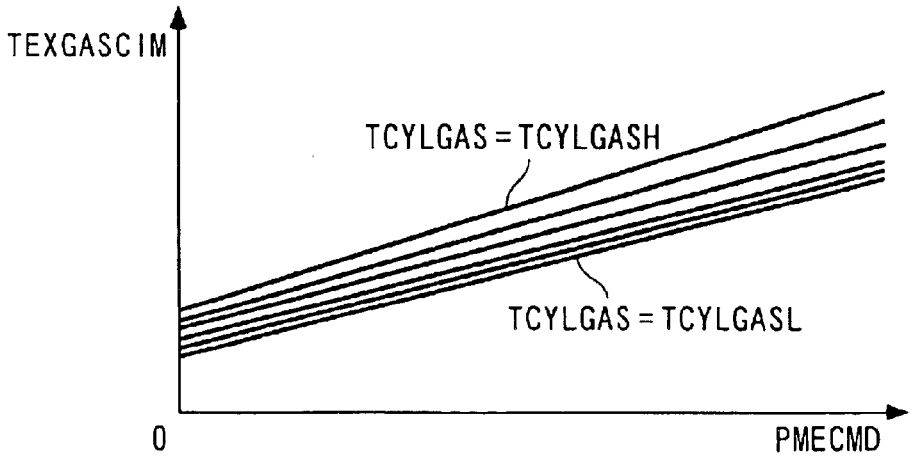
FIG. 8 is a diagram showing a TEXGASCIM map used in the FIG. 6 process.

FIG. 8 shows the TEXGASCIM map for the CI combustion mode. In this map, as the demanded torque PMECMD is larger and as the estimated working medium temperature TCYLGAS is higher, the map value TEXGASCIM is set to a larger value. This is because as the estimated working medium temperature TCYLGAS is higher, the temperature of working medium at the start of the compression stroke is higher, whereby the temperature of the combustion gases generated by combustion of the working medium becomes higher, and further, as described above, as the demanded torque PMECMD is larger, the temperature of combustion gases becomes higher.

In a step 28 following the step 26 or 27, the provisional combustion gas temperature value TEXGAST is calculated using the intermediate combustion gas temperature value TEXGASα set in the step 26 or 27, and the predetermined value TCYLWAL used in the step 23, by the following equation (4), followed by terminating the present process.

$$TEXGAST=TEXGAS_{\alpha}\cdot[1-KTEXGME\cdot(TDCME-TDCME_{\alpha})]+TCYLWAL\cdot KTEXGME\cdot(TDCME-TDCME_{\alpha}) \quad (4)$$

wherein KTEXGME represents a predetermined averaging coefficient (e.g. 0.01) smaller than a value of 1.0, and TDCME represents a repetition period of the present TDC signal. Further, $TDCME_{\alpha}$ represents a value of the repetition period TDCME which is set to that of the TDC signal generated when the engine speed NE is equal to a limit engine speed (e.g. 6000 rpm) within which high engine-speed F/C operation is carried out.

The first term on the right side of the equation (4) corresponds to the temperature of combustion gases directly obtained from combustion of working medium, and the second term on the same corresponds to the influence of the temperature of the cylinder block of the engine 3 on the temperature of the combustion gases. Further, as is apparent from the equation (4), a ratio of the second term to the sum of the terms on the right side is larger as the repetition period TDCME of the TDC signal is longer. This is because as the repetition period TDCME of the TDC signal is longer, the repetition period of the combustion cycle of each cylinder is longer, and hence the degree of influence of the temperature of the cylinder block on the temperature of the combustion gases is increased, resulting in the larger drop in the temperature of the combustion gases.

As described above, in the CI combustion mode, the target charging efficiency ETACC is determined as the target value of the charging efficiency of working medium (step 7 in FIG. 3), and the estimated EGR gas amount NEGR is estimated as an actual EGR gas amount remaining in the combustion chamber 3*c* (step 11 in FIG. 4). Then, the estimated working medium temperature TCYLGAS is calculated as the actual temperature of working medium at the start of the compression stroke, according to the estimated EGR gas amount NEGR and the target charging efficiency ETACC (step 15 in FIG. 5). Further, the estimated combustion gas temperature TEXGAS is calculated as the estimated temperature of combustion gases according to the estimated working medium temperature TCYLGAS and the demanded torque PMECMD (steps 27, 28, and 24 in FIG. 6).

As described hereinabove, since the estimated working medium temperature TCYLGAS is calculated according to the estimated EGR gas amount NEGR and the target charging efficiency ETACC, it is possible to properly estimate the actual temperature of working medium at the start of the compression stroke, while causing a ratio of the amount of the EGR gases with respect to the amount of working medium, i.e. a rise in the temperature of working medium, caused by the EGR gases, to be reflected therein. Further, since the estimated combustion gas temperature TEXGAS is calculated using the estimated working medium temperature TCYLGAS properly estimated as above, the temperature of the combustion gases can be properly predicted.

A target EGR gas amount-calculating process shown in FIG. 9 is executed by an interrupt handling routine in synchronism with inputting of each pulse of the TDC signal. First, in a step 31, it is determined whether or not the CI combustion mode flag F_HCCI is equal to 1. If the answer to this question is negative (NO), i.e. if the engine 3 is in the SI combustion mode, a target EGR gas amount NTEGRCMD is set to a value of 0 (step 32), followed by terminating the present process.

On the other hand, if the answer to the question of the step 31 is affirmative (YES), i.e. if the engine 3 is in the CI combustion mode, the process proceeds to a step 33, wherein the target EGR gas amount NTEGRCMD is calculated using the target working medium temperature TCYLGASC and the target charging efficiency ETACC determined in the respective steps 6 and 7 in FIG. 3, the maximum charged-gas amount NTCYLMAX used in the step 15 in FIG. 5, and the estimated combustion gas temperature TEXGAS calculated in the step 24 in FIG. 6, by the following equation (5), followed by terminating the present process.

$$NTEGRCMD=ETACC\cdot NTCYLMAX\cdot(TCYLGASC-TA)/(TEXGAS-TA) \quad (5)$$

wherein (TCYLGASC−TA) on the right side of the equation (5) represents the temperature difference between the target working medium temperature and the temperature of fresh air, and (TEXGAS−TA) on the right side of the equation (5) represents the temperature difference between the temperature of combustion gases and that of fresh air. Therefore, (TCYLGASC−TA)/(TEXGAS−TA), which is a ratio between the two temperature differences, represents a ratio of a temperature rise to be caused by the EGR gases with respect to a temperature rise which can be caused by the EGR gases. Consequently, by multiplying this ratio by ETACC·NTCYLMAX, it is possible to properly calculate the target EGR gas amount NTEGRCMD.

Figure 10:
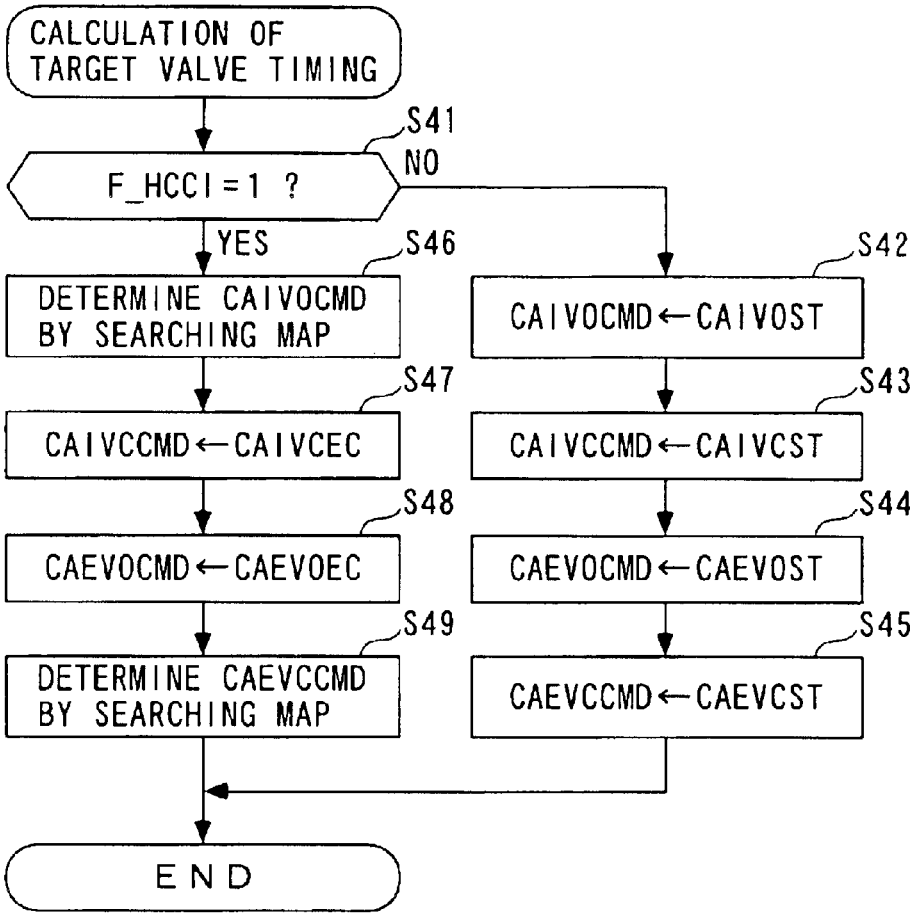
FIG. 10 is a flowchart showing a target valve timing-calculating process.

FIG. 10 shows a target valve timing-calculating process. This process is for calculating target valve timing for the intake valve 8 and the exhaust valve 9 of each cylinder, and executed by an interrupt handling routine in synchronism with inputting of each pulse of the TDC signal. Further, the valve timing of the valves is controlled such that it coincides with the calculated target valve timing. First, in a step 41, it is determined whether or not the CI combustion mode flag F_HCCI is equal to 1. If the answer to this question is negative (NO), i.e. if the engine 3 is in the SI combustion mode, target valve-opening timing CAIVOCMD for the intake valve 8 is set to predetermined intake valve-opening timing CAIVOST (e.g. 30 crank angle degrees before the top dead center position) for the SI combustion mode (step 42). Then, target valve-closing timing CAIVCCMD for the intake valve 8 is set to predetermined intake valve-closing timing CAIVCST (e.g. 30 crank angle degrees before the bottom dead center position) in a step 43.

Then, target valve-opening timing CAEVOCMD for the exhaust valve 9 is set to predetermined exhaust valve-opening timing CAEVOST (e.g. 30 crank angle degrees before the bottom dead center position) for the SI combustion mode (step 44). Subsequently, target valve-closing timing CAEVCCMD for the exhaust valve 9 is set to predetermined exhaust valve-closing timing CAEVCST (e.g. 30 crank angle degrees before the top dead center position) in a step 45, followed by terminating the present process.

On the other hand, If the answer to the question of the step 41 is affirmative (YES), i.e. if F_HCCI=1 holds, which means that the engine 3 is in the CI combustion mode, the process proceeds to a step 46, wherein the target valve-opening timing CAIVOCMD for the intake valve 8 is determined by searching a map, not shown, according to the engine speed NE, the demanded torque PMECMD, and the target EGR gas amount NTEGRCMD calculated in the step 33 in FIG. 9.

In the above map, the target valve-opening timing CAIVOCMD for the intake valve 8 is set to be more delayed, as the engine speed NE is lower, the demanded torque PMECMD is smaller, and the target EGR gas amount NTEGRCMD is larger. The reason for this will be described hereinafter.

Subsequently, the target valve-closing timing CAIVCCMD for the intake valve 8 is set to predetermined intake valve-closing timing CAIVCEC (e.g. 30 crank angle degrees before the bottom dead center position) for the CI combustion mode (step 47). Then, the target valve-opening timing CAEVOCMD for the exhaust valve 9 is set to predetermined exhaust valve-opening timing CAEVOEC (e.g. 30 crank angle degrees before the bottom dead center position) in a step 48.

Then, in a step 49, the target valve-closing timing CAEVCCMD for the exhaust valve 9 is determined by searching a map, not shown, according to the engine speed NE, the demanded torque PMECMD, and the target EGR gas amount NTEGRCMD, followed by terminating the present process.

In this above map, the target valve-closing timing CAEVCCMD for the exhaust valve 9 is set to be more advanced, as the engine speed NE is lower, the demanded torque PMECMD is smaller, and the target EGR gas amount NTEGRCMD is larger. The reason for this as follows: As described above, as the engine speed NE is lower, and the demanded torque PMECMD is smaller, self-ignition becomes more difficult to occur, and therefore, in such a case, the target valve-closing timing CAEVCCMD for the exhaust valve 9 is set to be more advanced in order to increase the amount of the EGR gases with a view to raising the temperature of working medium to make self-ignition easier to occur. Further, this is also to increase the amount of the EGR gases in a manner correspondent to the target EGR gas amount NTEGRCMD.

Further, the above-mentioned target valve-opening timing CAIVOCMD for the intake valve 8 is set in a manner associated with the above setting of the target valve-closing timing CAEVCCMD for the exhaust valve 9. More specifically, the target valve-closing timing CAEVCCMD for the exhaust valve 9 is set as described above, according to the engine speed NE, the demanded torque PMECMD, and the target EGR gas amount NTEGRCMD, whereby the amount of the EGR gases is increased to decrease the amount of the mixture to be supplied to the combustion chamber 3*c* by the increased amount of the EGR gases. Further, unless the valve-opening timing of the intake valve 8 is delayed as the valve-closing timing of the exhaust valve 9 is advanced, the combustion gases can flow into the intake pipe 4, and hence the target valve-opening timing CAIVOCMD for the intake valve 8 is delayed to prevent the combustion gases from flowing into the intake pipe 4.

As describe above, in the CI combustion mode, the target valve-opening timing CAIVOCMD for the intake valve 8 and the target valve-closing timing CAEVCCMD for the exhaust valve 9 are set according to the target EGR gas amount NTEGRCMD, whereby the actual amount of the EGR gases is controlled such that it becomes equal to the target EGR gas amount NTEGRCMD.

As describe heretofore, according to the present embodiment, in the CI combustion mode, the estimated working medium temperature TCYLGAS is calculated according to the target charging efficiency ETACC and the estimated EGR gas amount NEGR, and the estimated combustion gas temperature TEXGAS is calculated according to the estimated working medium temperature TCYLGAS.

This makes it possible to properly predict the temperature of the combustion gases. Further, since the target EGR gas amount NTEGRCMD is calculated according to the estimated combustion gas temperature TEXGAS determined as above, the temperature of the working medium at the start of the: next compression stroke can be accurately controlled even during a transient operation of the engine 3 without being adversely affected by a sharp change in the temperature of combustion gases. This makes it possible to accurately control the temperature of the working medium at the start of the compression stroke to a suitable temperature for self-ignition, thereby making it possible to prevent knocking and misfire from occurring. Further, since the temperature of combustion gases is determined by estimation thereof, it is possible to dispense with a sensor for detecting the temperature of combustion gases, thereby making it possible to construct the control system at reduced costs.

Further, in the SI combustion mode, the intermediate combustion gas temperature value TEXGASα is determined according to the intake air temperature TA, and the estimated combustion gas temperature TEXGAS is calculated according to the intermediate combustion gas temperature value TEXGASα, so that it is possible to properly predict the temperature of combustion gases. As a result, the aforementioned rich fuel control for protection of the three-way catalyst 11 can be carried out only when the temperature of combustion gases becomes actually very high, which makes it possible to improve the fuel economy.

It should be noted that the present invention is by no means limited to the embodiment described above, but it can be practiced in various forms. For example, although in the embodiment, the present invention is applied to the engine 3 that performs internal EGR, this is not limitative, but the present invention can also be applied to an engine that recirculates combustion gases using an exhaust gas-recirculating device. Further, although in the embodiment, the target charging efficiency ETACC is calculated as a parameter indicative of the estimated amount of charged working medium including the EGR gases, of course, the actual amount of working medium charged in the combustion chamber 3*c* may be estimated instead of calculating the target charging efficiency ETACC. Furthermore, the present invention can be applied to various types of industrial compression ignition internal combustion engines including engines for ship propulsion machines, such as an outboard motor having a vertically-disposed crankshaft.

It is further understood by those skilled in the art that the foregoing is a preferred embodiment of the invention, and that various changes and modifications may be made without departing from the spirit and scope thereof.

What is claimed is:

1. A compression ignition internal combustion engine that causes combustion of an air-fuel mixture by self-ignition in a combustion chamber, and includes an EGR device that causes part of combustion gases generated by the combustion to exist as EGR gases in the combustion chamber, the control system comprising:

EGR gas amount-estimating means for estimating an amount of EGR gases existing in the combustion chamber;

combustion gas temperature-estimating means for estimating temperature of combustion gases to be generated by combustion of working medium including the air-fuel mixture and the EGR gases, according to the estimated amount of the EGR gases; and target EGR gas amount-determining means for determining a target amount of EGR gases which should be caused to exist in the combustion chamber, according to the estimated temperature of the combustion gases.

2. A control system as claimed in claim 1, further comprising charged gas amount-estimating means for estimating an amount of working medium charged in the combustion chamber, and wherein said combustion gas temperature-estimating means estimates the temperature of the combustion gases further according to the estimated amount of the charged working medium.

3. A control system as claimed in claim 1, wherein the engine is configured to be capable of switching a combustion mode thereof between a compression ignition combustion mode in which combustion of the air-fuel mixture is caused by self-ignition, and a spark ignition combustion mode in which combustion of the air-fuel mixture is caused by spark ignition, and wherein the control system further comprises:

combustion mode-determining means for determining which of the compression ignition combustion mode and the spark ignition combustion mode should be selected as the combustion mode, and intake air temperature-detecting means for detecting temperature of intake air drawn into the combustion chamber, and wherein said combustion gas temperature-estimating means estimates the temperature of the combustion gases according to the estimated amount of the EGR gases when the determined combustion mode is the compression ignition combustion mode, and estimates the temperature of the combustion gases according to the detected temperature of the intake air when the determined combustion mode is the spark ignition combustion mode.

4. A control system as claimed in claim 3, wherein said combustion gas temperature-estimating means estimates the temperature of the working medium at the start of a compression stroke according to the estimated amount of the EGR gases and the detected temperature of the intake air when the determined combustion mode is the compression ignition combustion mode, and estimates the temperature of the combustion gases according to the estimated temperature of the working medium and a torque demanded of the engine.

5. A control system as claimed in claim 1, wherein the EGR device is an internal EGR device that causes the part of combustion gases generated by the combustion to exist as the EGR gases in the combustion chamber.

* * * * *